US007207905B2

(12) United States Patent
Aoyama

(10) Patent No.: US 7,207,905 B2
(45) Date of Patent: Apr. 24, 2007

(54) GOLF BALL DIMPLES

(75) Inventor: Steven Aoyama, Marion, MA (US)

(73) Assignee: Acushnet Company, Fairhaven, MA (US)

( * ) Notice: Subject to any disclaimer, the term of this patent is extended or adjusted under 35 U.S.C. 154(b) by 44 days.

(21) Appl. No.: 10/956,319

(22) Filed: Oct. 1, 2004

(65) Prior Publication Data

US 2006/0073915 A1 Apr. 6, 2006

(51) Int. Cl.
*A63B 37/12* (2006.01)

(52) U.S. Cl. ..... 473/384

(58) Field of Classification Search ..... 473/378–385
See application file for complete search history.

(56) References Cited

U.S. PATENT DOCUMENTS

| | | | | |
|---|---|---|---|---|
| 4,090,716 | A | 5/1978 | Martin et al. | 273/232 |
| 4,830,378 | A | 5/1989 | Aoyama | 273/232 |
| 5,174,578 | A | 12/1992 | Oka et al. | 273/232 |
| 5,209,485 | A | 5/1993 | Nesbitt et al. | 273/218 |
| 5,338,039 | A | 8/1994 | Oka et al. | 273/232 |
| 5,957,786 | A | 9/1999 | Aoyama | 473/379 |
| 6,162,136 | A | 12/2000 | Aoyama | 473/383 |
| 6,290,615 | B1 | 9/2001 | Ogg | 473/378 |
| 6,358,161 | B1 | 3/2002 | Aoyama | 473/383 |

OTHER PUBLICATIONS

"Golf Ball's Historic Flight, New Product Is Hailed for Distance, Accuracy," by L. Shapiro, The Washington Post at pp. D1. D4. Mar. 22, 2001.

*Primary Examiner*—Raeann Gorden
(74) *Attorney, Agent, or Firm*—Kristin D. Wheeler

(57) ABSTRACT

Provided herein is a golf ball that includes a generally spherical surface and an array of dimples formed on the surface. The undimpled portion of the spherical surface is the land area. At least one of the dimples includes a perimeter, a base, and a sidewall connecting the perimeter to the base. The sidewall forms an edge angle with the ball surface. The edge angle at a particular point on the perimeter is proportional to width of the land area adjacent to the point. Where the land area width is wide, the edge angle is high. Similarly, where the land area width is narrow, the edge angle is low. As the width of the land area in non-tessellated dimple patterns is determined by the position of the neighboring dimples, the edge angle varies cyclically around the perimeter, with the number of cycles corresponding to the number of neighboring dimples.

23 Claims, 7 Drawing Sheets

Section A-A

Section B-B

GOLF BALL DIMPLES

FIELD OF THE INVENTION

The present invention relates to golf balls, and more particularly, to a golf ball having improved dimples.

BACKGROUND OF THE INVENTION

Golf balls generally include a spherical outer surface with a plurality of dimples formed thereon. Conventional dimples are circular depressions that reduce drag and increase lift. These dimples are formed where a dimple wall slopes away from the outer surface of the ball forming the depression.

Drag is the air resistance that opposes the golf ball's flight direction. As the ball travels through the air, the air that surrounds the ball has different velocities thus, different pressures. The air exerts maximum pressure at a stagnation point on the front of the ball. The air then flows around the surface of the ball with an increased velocity and reduced pressure. At some separation point, the air separates from the surface of the ball and generates a large turbulent flow area behind the ball. This flow area, which is called the wake, has low pressure. The difference between the high pressure in front of the ball and the low pressure behind the ball slows the ball down. This is the primary source of drag for golf balls.

The dimples on the golf ball cause a thin boundary layer of air adjacent to the ball's outer surface to flow in a turbulent manner. Thus, the thin boundary layer is called a turbulent boundary layer. The turbulence energizes the boundary layer and helps move the separation point further backward, so that the layer stays attached further along the ball's outer surface. As a result, a reduction in the area of the wake, an increase in the pressure behind the ball, and a substantial reduction in drag are realized. It is the circumference of each dimple, where the dimple wall drops away from the outer surface of the ball, which actually creates the turbulence in the boundary layer.

Lift is an upward force on the ball that is created by a difference in pressure between the top of the ball and the bottom of the ball. This difference in pressure is created by a warp in the airflow that results from the ball's backspin. Due to the backspin, the top of the ball moves with the airflow, which delays the air separation point to a location further backward. Conversely, the bottom of the ball moves against the airflow, which moves the separation point forward. This asymmetrical separation creates an arch in the flow pattern that requires the air that flows over the top of the ball to move faster than the air that flows along the bottom of the ball. As a result, the air above the ball is at a lower pressure than the air underneath the ball. This pressure difference results in the overall force, called lift, which is exerted upwardly on the ball. The circumference of each dimple is important in optimizing this flow phenomenon, as well.

By using dimples to decrease drag and increase lift, almost every golf ball manufacturer has increased their golf ball flight distances. In order to optimize ball performance, it is desirable to have a large number of dimples, hence a large amount of dimple circumference, which is evenly distributed around the ball. In arranging the dimples, an attempt is made to minimize the space between dimples, referred to herein as "land area", because the land area does not improve aerodynamic performance of the ball. In practical terms, this usually translates into 300 to 500 circular dimples with a conventional sized dimple having a diameter that typically ranges from about 0.100 inches to about 0.180 inches.

One attempt to improve the aerodynamics of a golf ball is suggested in U.S. Pat. No. 6,162,136, wherein a preferred solution is to minimize the land surface or undimpled surface of the ball to maximize dimple coverage. One way of maximizing the dimple coverage of the ball is to pack closely together circular dimples having various sizes, as disclosed in U.S. Pat. Nos. 5,957,786 and 6,358,161. In practice, the circular dimple coverage is limited to about 85% or less when non-overlapping dimples are used.

Another attempt to maximize dimple coverage is to use polygonal dimples with polyhedron dimple surfaces, i.e., dimple surfaces constructed from planar surfaces, as suggested in a number of patent references including U.S. Pat. Nos. 6,290,615, 5,338,039, 5,174,578, 4,830,378, and 4,090,716, among others. Theoretically, higher dimple coverage is attainable with these polygonal dimples, as the dimples may be tessellated, i.e., the dimples are arranged in a tiled pattern with generally uniform land widths between the dimples.

In non-tessellated dimple configurations, the land areas have cross-sectional shapes that vary with position in an uncontrolled manner. The width and edge angle associated with a given location of land area is simply an unintended consequence of the dimples that surround it.

Hence, there remains a need in the art for a golf ball that has a high dimple coverage and superior aerodynamic performance.

SUMMARY OF THE INVENTION

Accordingly, provided herein is a dimple for a golf ball including a generally circular perimeter (including ovals, ellipses, egg shapes, and other generally round shapes), a base, and a sidewall connecting the perimeter to the base. The sidewall may form a distinct angular junction with the base, or it may smoothly blend into the base. Along the perimeter, a sidewall tangent line and a ball phantom surface tangent line form an edge angle. The edge angle varies cyclically around the perimeter of the dimple. The edge angle can also vary cyclically around the perimeter of a group or cluster of dimples.

Also provided herein is a golf ball that includes a generally spherical land surface and an array of dimples formed on the surface. At least one of the dimples includes a perimeter, a base, and a sidewall forming an edge angle with the adjacent land area. The edge angle varies cyclically around the perimeter of a single dimple or a cluster of dimples. The edge angle at a particular point on the perimeter varies relative to the width of the adjacent land area. Preferably, the edge angle is greater where the width of the adjacent land area is greater, and generally smaller where the width of the adjacent land area is smaller.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
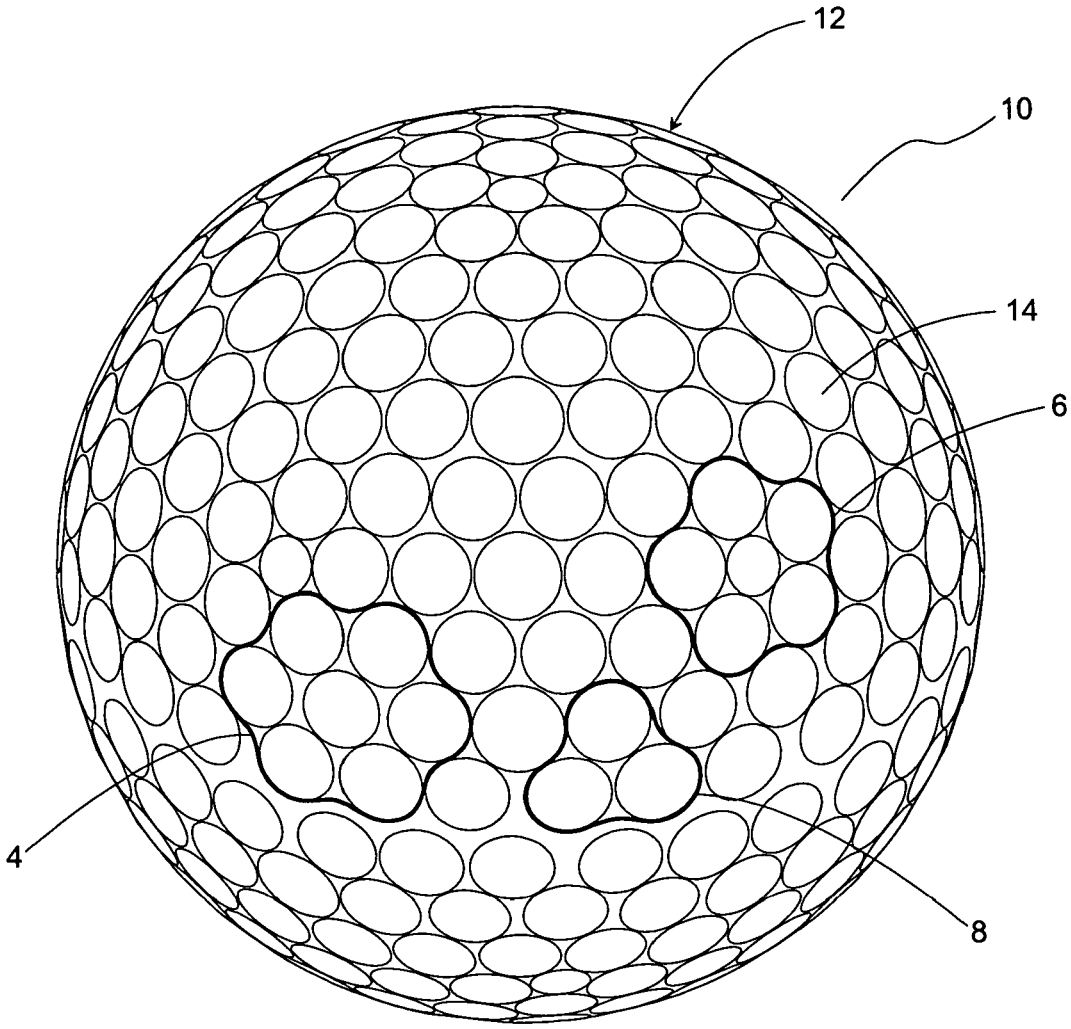
Figure 1 Prior Art
FIG. 1 is a perspective view of a conventional golf ball having circular dimples arranged thereupon in an icosahedron pattern.

A conventional golf ball 10, the TITLEIST NXT golf ball, is shown in FIG. 1. This particular ball is shown for the purposes of example only; the present invention is applicable to any golf ball having dimples arranged in a pattern that is not tessellated. Golf ball 10 includes a substantially spherical outer surface 12 with a plurality of dimples 14 disposed thereupon. Preferably, dimples 14 are depressions formed in outer surface 12, although dimples 14 may also be protrusions extending from outer surface 12. Dimples 14 are arranged on outer surface 12 in a dimple pattern chosen to provide coverage for optimal aerodynamic purposes. Typically, dimples 14 are arranged on outer surface 12 in a tightly packed fashion. Many patterns are known and used in the art for arranging dimples 14 on outer surface 12, for example patterns based in general on three Platonic solids: icosahedron (20-sided polyhedron), dodecahedron (12-sided polyhedron), and octahedron (8-sided polyhedron). The pattern shown in FIG. 1 is an icosahedron pattern.

For a given section of outer surface 12, any of the dimple packing patterns used in the art results in an array of dimples 14. For example, in the case of a typical icosahedron-based layout, most of dimples 14 are arranged in a hexagonal array, i.e., each dimple 14 has six (6) neighboring dimples 14, and a few dimples 14 are arranged in a pentagonal array, i.e., each dimple 14 has five (5) neighboring dimples 14. In an octahedron-based layout, commonly many of dimples 14 are arranged in a square array. Other arrangement schemes may not be as regular and ordered as these examples, but each dimple 14 typically has three (3) to seven (7) closely neighboring dimples.

Figure 2:
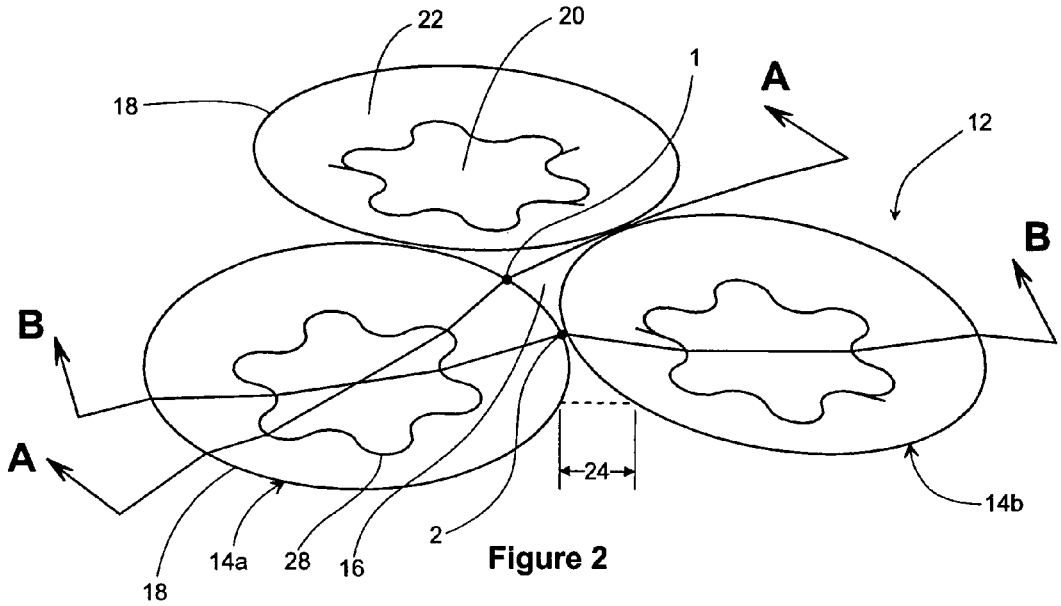
FIG. 2 is a perspective view of a partial enlarged portion of the outer surface of a golf ball according to the present invention.
Figure 2A:
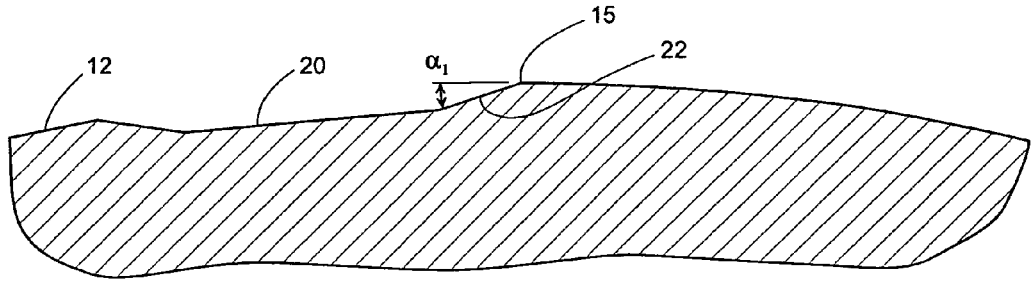
FIG. 2*a* is a cross-sectional view of the outer surface of FIG. 2, taken along line A—A thereof.
Figure 2B:
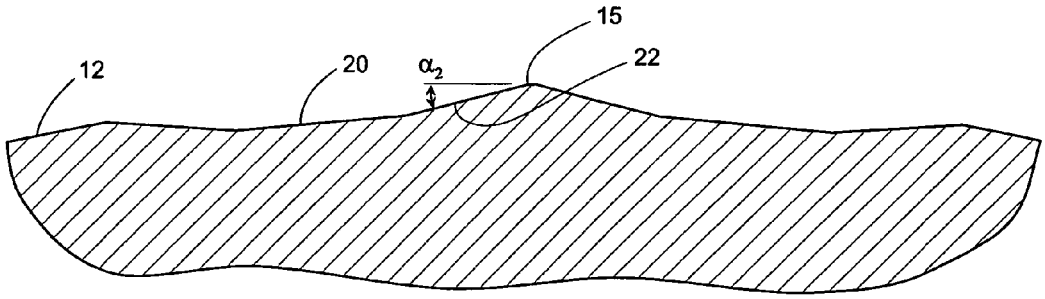
FIG. 2*b* is a cross-sectional view of the outer surface of FIG. 2, taken along line B—B thereof.

FIG. 2 shows a section of a golf ball outer surface 12 including dimples 14 according to a preferred embodiment of the present invention. FIGS. 2*a* and 2*b* show cross-sectional views of dimples 14. The undimpled portion of outer surface 12 is land area 16, which separates dimples 14.

Each dimple 14 includes a perimeter 18 defining a shape on outer surface 12. Perimeter 18 is preferably circular or substantially circular, such as oval, elliptical, or egg-shaped. Other shapes for perimeter 18 are appropriate, including, for this embodiment, any shape that does not result in a tessellated pattern of dimples 14. It is believed that polygonal dimples with polyhedron dimple surfaces do not achieve performance improvements commensurate with their coverage improvements. It is also believed that the linear edges of the polygonal dimples and the connecting sharp apices generate more drag than the curved edges of the circular dimples. In other embodiments, polygonal dimples that result in tessellated arrangements are appropriate.

When substantially circular dimples 14 are arranged into an array, land area width 24 between any two dimples 14 is non-uniform. Land area width 24 at a point on the perimeter 18 of a dimple is defined as the distance from that point to a second point on the perimeter 18 of a neighboring dimple, measured along a radial path from the centroid of the first dimple. As seen in FIG. 2, land area 16 is generally triangular in shape between dimples 14, resulting in varying land area widths 24 at different points between any two dimples 14.

Each dimple 14 also includes a base 20 and a sidewall 22. Sidewall 22 connects perimeter 18 with base 20. Sidewall 22 is preferably straight in cross-section, although it may also have other configurations such as curved. It may form an angular junction with base 20, or it may blend smoothly into base 20. Base 20 is preferably flat, although base 20 may also be curved, for example, having a curvature concentric with the spherical curvature of outer surface 12. As shown in FIG. 2, base perimeter 28 has a non-circular shape, in this embodiment, a six-lobed shape. As perimeter 18 is circular and base perimeter 28 is non-circular, the angle at which sidewall 22 diverges from outer surface 12, edge angle $\alpha$, varies around perimeter 18.

Figure 1A:
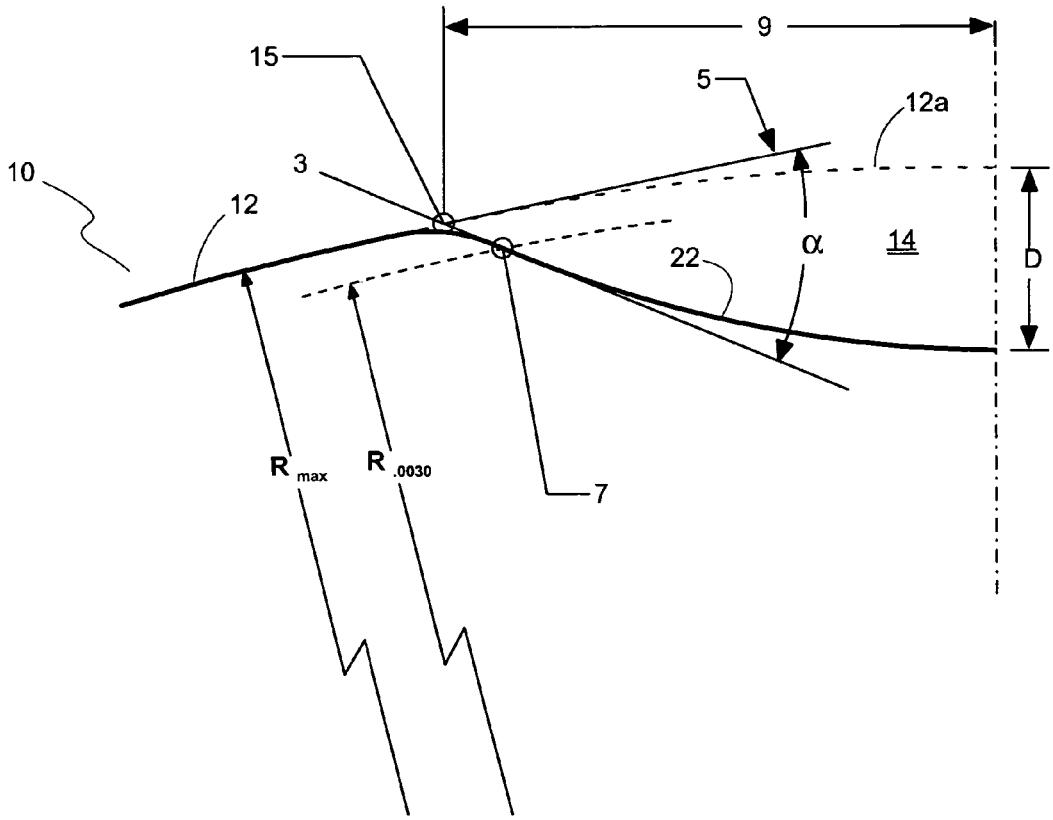
FIG. 1*a* is a schematic, cross-sectional view showing half of a circular dimple.

Edge angle $\alpha$ may be difficult to measure with precision, as the dimple edge 15, i.e., the point at which sidewall 22 meets perimeter 18, is often rounded due to manufacturing considerations or to the effects of finishing paint coats. For the purposes of discussion, edge angle $\alpha$ is defined as shown in FIG. 1*a*. Golf ball 10 has a maximum outer radius $R_{max}$ and a phantom outer surface 12*a* that extends over dimple 14 of depth D. A sidewall tangent line 3 is a line that is tangent to sidewall 22 at a point 7 that is located 0.0030 inches below outer surface 12 thereby defining a second radius $R_{0.0030}$. Edge 15 is defined as the point at which sidewall tangent line 3 intersects phantom outer surface 12*a*. A dimple radius 9 is also measured from edge 15. A phantom outer surface tangent line 5 is a line tangent to phantom outer surface 12*a* at edge 15. Edge angle $\alpha$ is measured at the intersection of a sidewall tangent line 3 with phantom outer surface tangent line 5.

Edge angle $\alpha$ varies around perimeter 18 of dimple 14. It is known in the art that for dimple patterns with wider dimple spacing overall, greater flight distance will be achieved if the edge angle is relatively high. Since the shape of the land area influences the golf ball's aerodynamic characteristics just as the shape of the dimple does, it is beneficial to exert some control over this aspect as well. For dimple patterns with wider overall dimple spacing, greater flight distance may be achieved with a generally greater edge angle $\alpha$. Taking this concept to the individual dimple level, at any particular point along perimeter 18 edge angle $\alpha$ is proportional to land area width 24 adjacent to that point. For example, as shown in FIG. 2, at a point 1 along perimeter 18 of a particular dimple 14*a* that is farthest from a neighboring dimple 14*b*, the local edge angle $\alpha_1$ is relatively large. Similarly, at a point 2 along perimeter 18 of dimple 14*a* that is closest to neighboring dimple 14*b*, the local edge angle $\alpha_2$ is relatively small. In another example, the local edge angle is small where the distance to the neighboring dimple is large. A preferred difference between edge angles $\alpha_1$ and $\alpha_2$ is about 1 to about 8 degrees, more preferably about 3 to about 6 degrees, and most preferably about 4 to about 5 degrees. Edge angles typically range from about 12 degrees to about 18 degrees, although in some cases they may be somewhat lower or considerably higher. Values are usually selected to maximize the ball's flight distance while producing the desired trajectory shape. Optimal edge angles are affected by various factors such as the spin characteristics of the ball, the amount of the ball's surface that is occupied by dimples, the depth of the dimple, and the cross-sectional shape of the dimple.

The variation of edge angle $\alpha$ is preferably cyclic around perimeter 18, with the same number of cycles as neighboring dimples. In the embodiment shown in FIG. 2, each dimple shown has six neighbors (not all of which are shown) and six cycles. Within each dimple 14 and in different dimples 14 on the same golf ball 10, the cycles may have varying wavelengths and amplitudes, depending upon the spatial relationships among dimple 14 and its neighbors. For edge angle $\alpha$, preferably local maxima are located on perimeter 18 where land area widths 24 are widest, and local minima would be aligned where land area widths are most narrow. In order to achieve this cycling of edge angle $\alpha$ in this embodiment, in one embodiment the shape of base perimeter 28 is designed such that the lobes of base perimeter 28 point to the widest sections of land area 16. In other words, the radius of base perimeter 28 is largest when aligned with the largest land area width 24, creating the largest edge angle $\alpha$. In another embodiment, the edge angle varies along the perimeter of a cluster of dimples, e.g., a group of three dimples 8, a pentagonal array 6, or a hexagonal array 4, examples of which are shown in FIG. 1.

Figure 3:
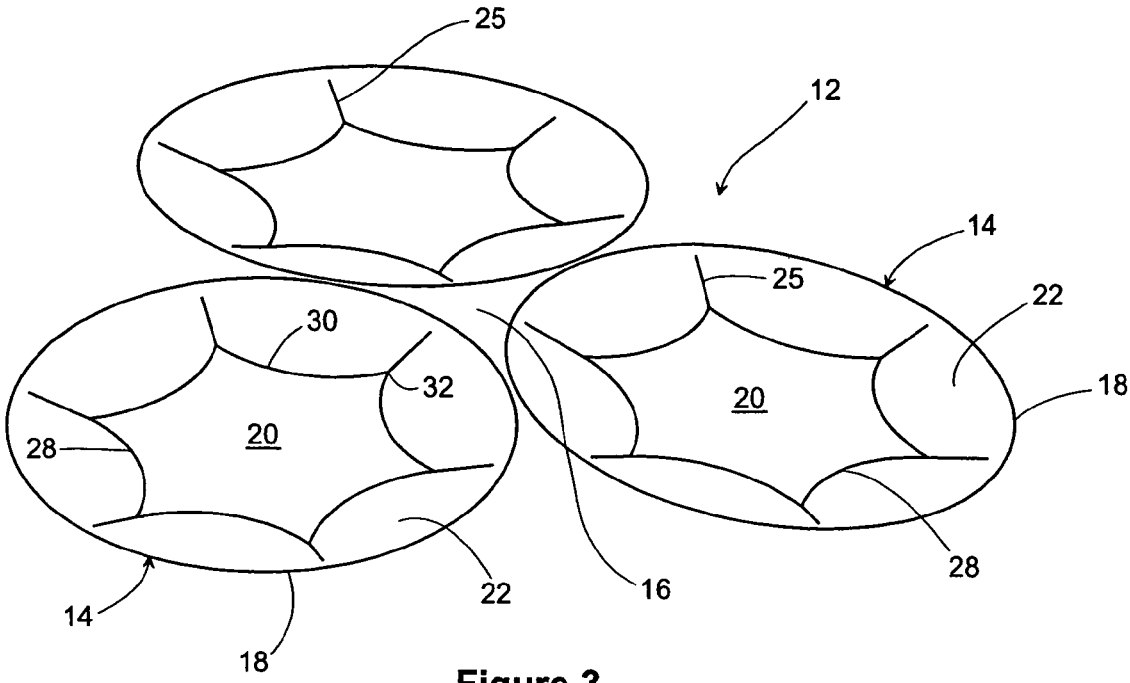
FIG. 3 is a perspective view of an enlarged portion of the outer surface of a golf ball according to an alternate embodiment of the present invention.

FIG. 3 shows an alternate embodiment of dimples 14. This embodiment is similar to the embodiment shown in FIG. 2, where each dimple 14 has a circular perimeter 18 located on an outer surface 12 of a golf ball (not shown in full). Further, sidewalls 22 connect dimple perimeter 18 with a flat base 20. Sidewalls 22 are not smooth and continuous around dimple 14. Instead, smooth convex sections of sidewall 22 meet at creased valleys 25.

In this embodiment, a base perimeter 28 has a different shape. Base perimeter 28 includes multiple rounded edges 30 that meet at points 32 of valleys 25 as opposed to the rounded, sinusoidal lobes of the embodiment shown in FIG. 2. The orientation of the shape of base perimeter 28 is similar to that of the embodiment shown in FIG. 2, i.e., points 32 are positioned to align with the widest sections of a land area 16. Consequently, the edge angle of each dimple 14 will vary cyclically around perimeter 18.

Figure 4:
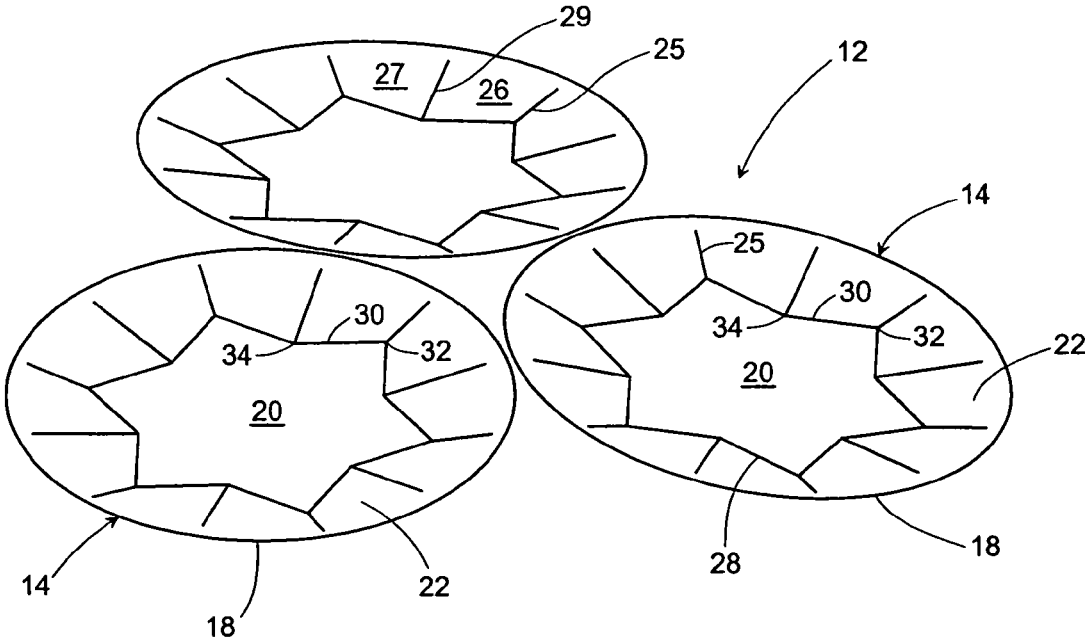
FIG. 4 is a perspective view of an enlarged portion of the outer surface of a golf ball according to yet another alternate embodiment of the present invention.

FIG. 4 shows yet another alternate embodiment of dimples 14. Similar to the embodiment shown in FIG. 2, each dimple 14 has a circular perimeter 18 located on an outer surface 12 of a golf ball (not shown in full). Further, sidewalls 22 connect perimeter 18 with a flat base 20. In this embodiment, sidewalls 22 are not smooth and continuous around dimple 14. Instead, sidewall 22 comprises pairs of generally flat portions 26, 27 between valleys 25. Portions 26 and 27 intersect to form ridge 29. Ridges 29 are associated with the thinnest land area.

In this embodiment, a base perimeter 28 is generally star-shaped, with multiple straight segments 30 bordering planar portions 26, 27 that meet at outer points 32 and inner points 34. The orientation of the shape of base perimeter 28 is similar to that of the embodiment shown in FIG. 2, i.e., outer points 32 are positioned to align with valleys 25 and the widest sections of a land area 16 and inner points 34 are positioned to align with ridges 29 and the narrowest sections of land area 16. Consequently, the edge angle of each dimple 14 will vary cyclically around perimeter 18.

Figure 5:
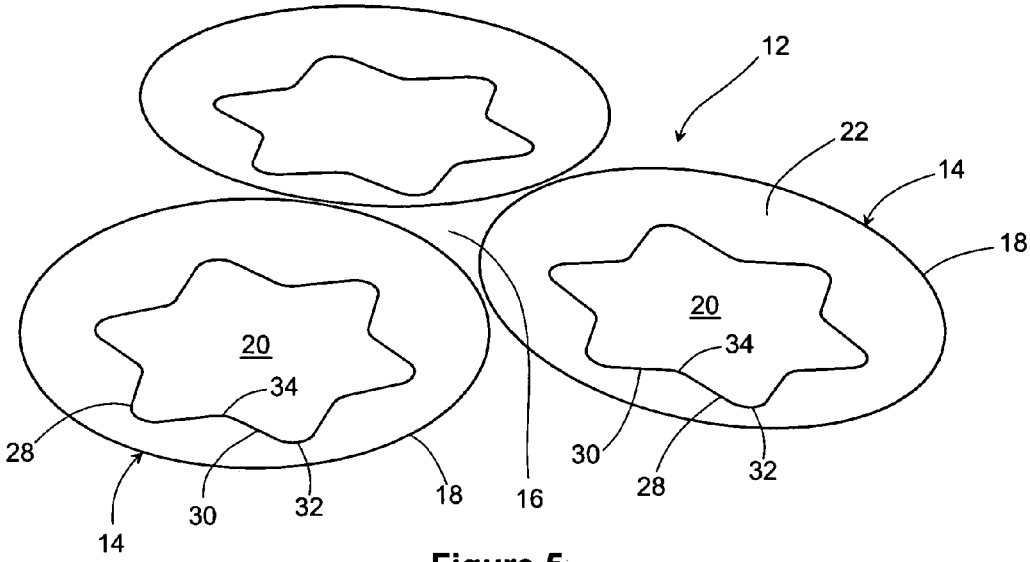
FIG. 5 is a perspective view of an enlarged portion of the outer surface of a golf ball according to yet another alternate embodiment of the present invention.

FIG. 5 shows yet another alternate embodiment of dimples 14. Similar to the embodiment shown in FIG. 4, each dimple 14 has a circular perimeter 18 located on an outer surface 12 of a golf ball (not shown in full). Further, sidewalls 22 connect perimeter 18 with a flat base 20. However, in this embodiment, a base perimeter 28 is generally star-shaped, with multiple straight segments 30 that meet at rounded outer points 32 and rounded inner points 34. These rounded points eliminate the sharp valleys 25 and ridges 29 of the embodiment of FIG. 4. The orientation of the shape of base perimeter 28 is similar to that of the embodiment shown in FIG. 4, i.e., rounded outer points 32 are positioned to align with the widest sections of a land area 16 and rounded inner points 34 are positioned to align with the narrowest sections of land area 16. Consequently, the edge angle $\alpha$ of each dimple 14 varies cyclically around perimeter 18, where the number of cycles equals the number of neighboring dimples, in this embodiment, six.

Figure 6:
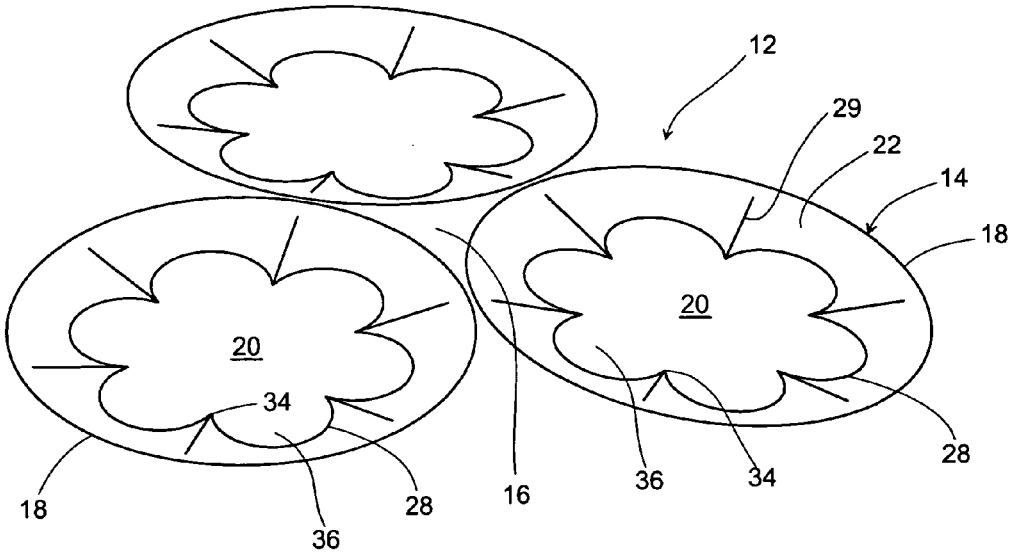
FIG. 6 is a perspective view of an enlarged portion of the outer surface of a golf ball according to yet another alternate embodiment of the present invention.

FIG. 6 shows yet another alternate embodiment of dimples 14. Similar to the other embodiments, each dimple 14 has a circular perimeter 18 located on an outer surface 12 of a golf ball (not shown in full). Further, sidewalls 22 connect perimeter 18 with a preferably flat base 20. In this embodiment, sidewalls 22 are not smooth and continuous around dimple 14. Concave sections of sidewall 22 meet and form ridges 29.

In this embodiment, a base perimeter 28 is generally flower-shaped, with multiple lobes 36 that meet at inner points 34. The orientation of the shape of base perimeter 28 is similar to that of the embodiment shown in FIG. 2, i.e., lobes 36 are positioned to align with the widest sections of a land area 16 and inner points 34 are positioned to align with the narrowest sections of land area 16. Consequently, the edge angle of each dimple 14 will vary cyclically around perimeter 18, where the number of cycles equals the number of neighboring dimples, in this embodiment, six.

Figure 7:
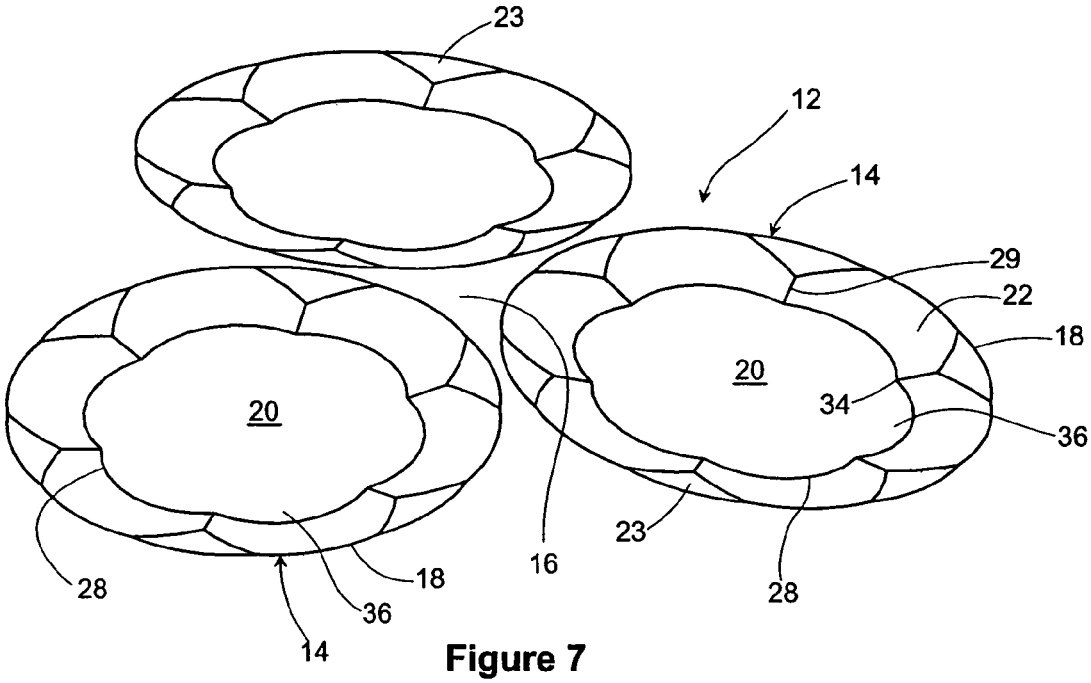
FIG. 7 is a perspective view of an enlarged portion of the outer surface of a golf ball according to yet another alternate embodiment of the present invention.

FIG. 7 shows yet another embodiment of dimples 14 according to the present invention. In this embodiment, dimples 14 include a generally circular but slightly scalloped perimeter 18 formed on an outer surface 12. This type of dimple is formed as multiple overlapping depressions. Sidewalls 22 connect perimeter 18 with a preferably flat base 20. In this embodiment, sidewalls 22 are not smooth and continuous around dimple 14. Instead, rounded concave sections of sidewall 22 meet and form ridges 29.

The shape of a base perimeter 28 is similar to that of the base perimeter shown in FIG. 6, forming shallow lobes 36 that meet at points 34. Sidewall 22 also has outer wedges 23 opposite to inner points 34 and correspond to the thinnest land area. The orientation of base 20 is similar to that of the embodiment shown in FIG. 6, i.e., shallow lobes 36 are positioned to align with the widest sections of a land area 16, and inner points 34 and wedges 23 are positioned to align with the narrowest sections of land area 16. Consequently, the edge angle of each dimple 14 will vary cyclically around perimeter 18, where the number of cycles equals the number of neighboring dimples, in this embodiment, six.

Figure 8:
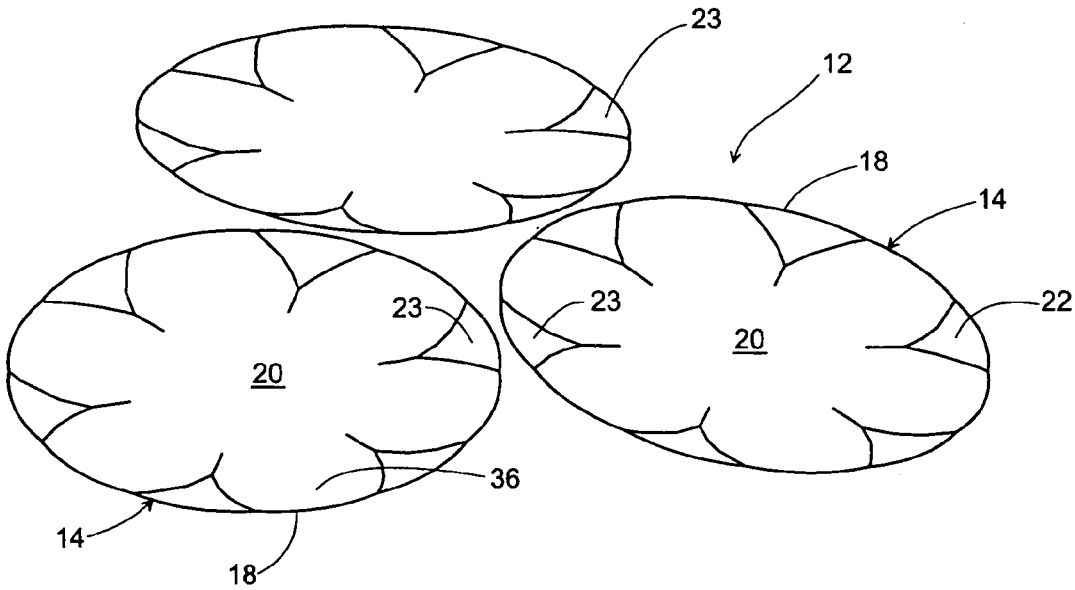
FIG. 8 is a perspective view of an enlarged portion of the outer surface of a golf ball according to yet another alternate embodiment of the present invention.

FIG. 8 shows yet another embodiment of dimples 14 according to the present invention. In this embodiment, similar to the embodiment shown in FIG. 7, dimples 14 include a generally circular but slightly scalloped perimeter 18 formed on an outer surface 12. Sidewalls 22 connect perimeter 18 with a base 20.

Base 20 is preferably non-planar and has a plurality of lobes 36. Lobes 36 extend to dimple perimeter 18 and forms the largest edge angle α. Sidewall 22 is discontinuous in this embodiment and comprises discrete, spaced-apart wedges 23. Wedges 23 are associated with the smallest edge angle α. Consequently, the edge angle of each dimple 14 will vary cyclically around perimeter 18, where the number of cycles equals the number of neighboring dimples, in this embodiment, six.

Figure 9:
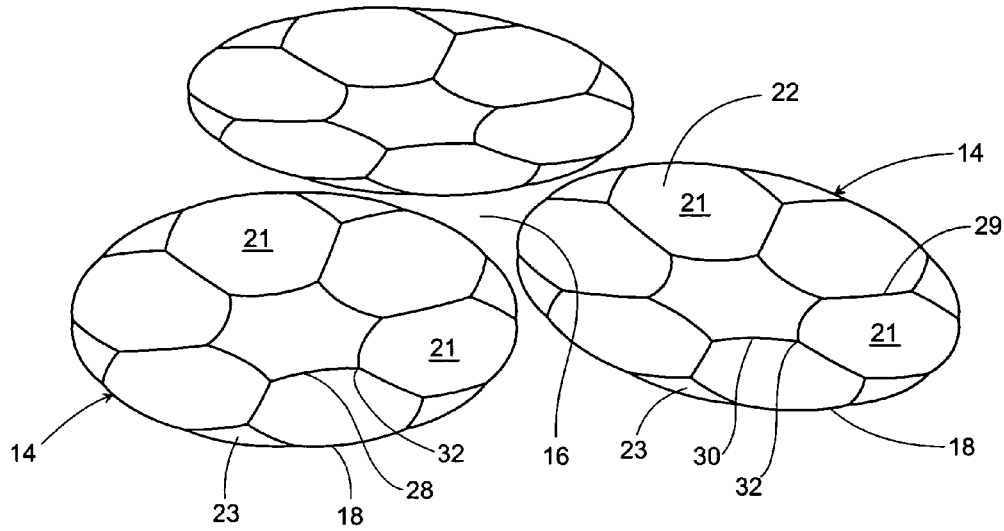
FIG. 9 is a perspective view of an enlarged portion of the outer surface of a golf ball according to yet another alternate embodiment of the present invention.

FIG. 9 shows yet another embodiment of dimples 14 according to the present invention. In this embodiment, similar to the embodiment shown in FIG. 7, dimples 14 include a generally circular but slightly scalloped perimeter 18 formed on an outer surface 12. Sidewalls 22 connect perimeter 18 with a preferably flat base 20. In this embodiment, sidewalls 22 are not smooth and continuous around dimple 14. Instead, concave hexagonal sections 21 of sidewall 22 meet thereby forming ridges 29. Further, wedges 23 are formed between the upper portions of adjacent hexagonal sections 21. Wedges 23 are positioned to correspond with the narrowest sections of land area 16. Wedges 23 diverge from perimeter 18 at a shallower angle than do hexagonal sections 21. Consequently, the edge angle α of each dimple 14 will vary cyclically around perimeter 18.

In this embodiment, similar to the embodiment shown in FIG. 3, base perimeter 28 includes multiple rounded edges 30 that meet at points 32 as opposed to the rounded, sinusoidal lobes of the embodiment shown in FIG. 2. The orientation of the shape of base perimeter 28 is such that points 32 are positioned to align with wedges 23 and the narrowest portions of land area 16.

Figure 10:
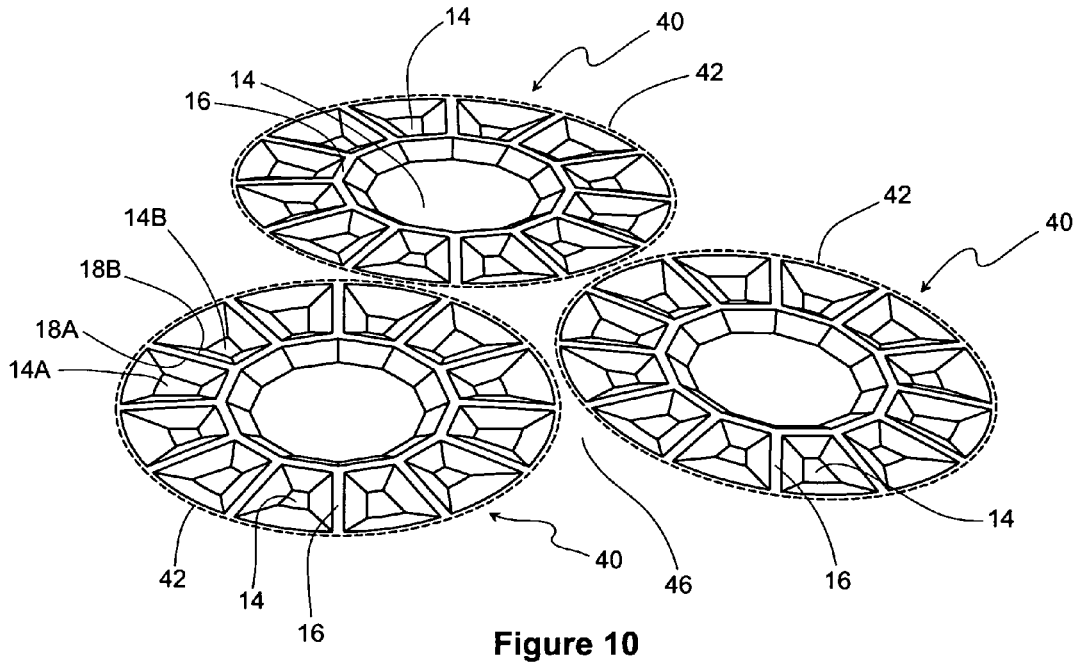
FIG. 10 is a perspective view of an enlarged portion of the outer surface of a golf ball according to yet another alternate embodiment of the present invention.

In yet another embodiment, shown in FIG. 10, a golf ball 10 includes a surface texture that includes clusters 40 of dimples 14. A phantom cluster perimeter 42 is generally circular in shape. Dimples 14 may have any shape or configuration known in the art, including but not limited to tessellated polygons, partial polygons with at least one arcuate edge, and circular. As shown, dimples 14 are polygons and partial polygons arranged in a generally tessellated pattern. Within phantom cluster perimeter 42, a land area width 16 is uniform between two adjacent dimples, i.e., a dimple perimeter 18A of a first dimple 14A is substantially parallel to a second dimple perimeter 18B of a second dimple 14B. However, an inter-cluster land area width 46 between adjacent clusters 40 varies due to the curved shape of phantom cluster perimeter 42. As such, an edge angle α of a dimple 14 located along phantom cluster perimeter 42 is chosen in accordance with the adjacent inter-cluster land area width 46. Thus, edge angle α preferably varies cyclically around phantom cluster perimeter 42. Where the land width 46 is small, the edge angle α is small, and where the land width 46 is large, the edge angle α is large.

As will be readily recognized by those in the art, the invention is not limited to increasing the aerodynamic efficiency by aligning higher edge angles with the areas of largest land. Modern golf balls may be very aerodynamically efficient due to the recent advances in golf ball compositions and dimple designs. As such, some of the high performance golf balls may eventually exceed the maximum distance of 280 yards±6%, when impacted by a standard driver at 160 feet per second and at 10° angle as set forth by the United States Golf Association (USGA). (See "Golf Ball's Historic Flight, New Product Is Hailed for Distance, Accuracy," by L. Shapiro, The Washington Post at pp. D1, D4, Mar. 22, 2001). As disclosed in U.S. Pat. No. 5,209,485, the disclosure of which is incorporated herein by reference, to reduce the distance that a golf ball would travel, inefficient dimple patterns and low resilient polymeric compositions are suggested. As such, the present invention may be used to manipulate, not just increase, the aerodynamic efficiency. In order to increase aerodynamic efficiency, higher edge angles are aligned with the area of largest land, as described above. Similarly, in order to reduce aerodynamic efficiency to meet USGA performance standards, higher edge angles may be aligned with the areas of smallest land.

While various descriptions of the present invention are described above, it is understood that the various features of the embodiments of the present invention shown herein can be used singly or in combination thereof. The dimples of the present invention can be incorporated into other types of objects in flight. Additionally, a plurality of dimples having different configurations such as the various embodiments described above can be incorporated on a single golf ball. This invention is also not to be limited to the specifically preferred embodiments depicted therein.

What is claimed is:

1. A golf ball dimple comprising:
a generally circular perimeter;
a base; and
a sidewall connecting the perimeter to the base,
wherein a sidewall tangent line and a ball phantom surface tangent line form an edge angle, and
wherein the edge angle varies cyclically around the perimeter.

2. The dimple of claim 1, wherein the base includes lobes positioned around a base perimeter.

3. The dimple of claim 1, wherein a base perimeter of the base is generally sinusoidal in shape.

4. The dimple of claim 1, wherein a base perimeter of the base is star-shaped.

5. The dimple of claim 1, wherein the generally circular perimeter is selected from a group consisting of a circle, an ellipse, an oval, and an egg-shape.

6. The dimple of claim 1, wherein the generally circular perimeter is scalloped.

7. The dimple of claim 1, further comprising valleys and/or ridges formed on the sidewall.

8. A golf ball comprising:
a generally spherical surface;
a plurality of dimples separated by a land area formed on the surface, wherein at least one of the dimples comprises
a perimeter,
a base,
a sidewall having an edge angle and connecting the perimeter to the base, wherein the edge angle varies cyclically around the perimeter; and
wherein the edge angle at a particular point on the perimeter corresponds to a width of the land area proximate the edge angle.

9. The dimple of claim 8, wherein the edge angle at any point on the perimeter is directly related to the width of the land area.

10. The dimple of claim 8, wherein the edge angle at any point on the perimeter is inversely related to the width of the land area.

11. The dimple of claim 8, wherein a number of edge angle cycles is the same as a number of neighboring dimples.

12. The dimple of claim 8, wherein a first edge angle is formed at a point along the perimeter where the land area width is relatively wide and a second edge angle is formed at a point along the perimeter where the land area width is relatively narrow, and wherein the first edge angle is greater than a second edge angle.

13. The dimple of claim 12, wherein the first edge angle is 1 to 8 degrees greater than the second edge angle.

14. The dimple of claim 12, wherein the first edge angle is 3 to 6 degrees greater then the second edge angle.

15. The dimple of claim 12, wherein the first edge angle is 4 to 5 degrees greater than the second edge angle.

16. The dimple of claim 12, wherein a maximum edge angle corresponds to a point on the perimeter where the land area width is widest, and a minimum edge angle corresponds to a point on the perimeter where the land area width is narrowest.

17. The golf ball of claim 8, wherein a base perimeter of the base comprises lobes.

18. The golf ball of claim 8, wherein the sidewall comprises valleys.

19. The golf ball of claim 8, wherein the sidewall comprises ridges.

20. A surface texture for a golf ball comprising a plurality of dimples arranged in a generally circular configuration, wherein each of the dimples includes an edge angle defined by a sidewall tangent line and a ball surface tangent line, and wherein the edge angle of the dimples varies along a perimeter of the configuration.

21. The surface texture of claim 20, wherein the edge angle of at least one dimple disposed along the perimeter of the configuration corresponds to a width of a land area separating the dimple and a neighboring plurality of dimples proximate the dimple.

22. The surface texture of claim 20, wherein the edge angle of the dimples along the perimeter of the configuration varies cyclically therearound.

23. The surface texture of claim 20, wherein the plurality of dimples are tessellated within the perimeter.

* * * * *